United States Patent [19]

Tsukamoto et al.

[11] 4,065,948

[45] * Jan. 3, 1978

[54] ROLL-FORMING DIES IN A CROSS-ROLLING MACHINE

[75] Inventors: Hidehiko Tsukamoto; Nobutaka Maeda, both of Hiroshima, Japan

[73] Assignee: Mitsubishi Jukogyo Kabushiki Kaisha, Tokyo, Japan

[ * ] Notice: The portion of the term of this patent subsequent to May 4, 1993, has been disclaimed.

[21] Appl. No.: 628,558

[22] Filed: Nov. 3, 1975

[30] Foreign Application Priority Data

Nov. 25, 1974 Japan ..... 49-134211

[51] Int. Cl.[2] ..... B21H 1/18

[52] U.S. Cl. ..... 72/108; 72/469

[58] Field of Search ..... 72/71, 108, 467

[56] References Cited

U.S. PATENT DOCUMENTS 186,905 1/1877 Vanstone ..... 72/108

3,938,375 2/1976 Koizumi et al. ..... 72/108

3,954,001 5/1976 Tsukamoto et al. ..... 72/469

*Primary Examiner*—Lowell A. Larson

*Attorney, Agent, or Firm*—Cushman, Darby & Cushman

[57] ABSTRACT

Improved roll-forming dies in a cross-rolling machine are described herein, which enable a shaped surface having any arbitrary inclination angle to be self-generated when a shaft portion of a stepped cylindrical article having a large diameter-reduction factor is formed by rolling. The improved dies are distinguished from the conventional ones in that a height of a die top portion contacting with a raw material rod with respect to a reference surface of said die is successively and continuously increased in the direction of advance of the die from a start point of a depression spreading portion of the die or its proximity up to a start point of a finishing portion or its proximity, and also in that a width of a shaping inclined surface of the roll-forming die is gradually reduced in the direction of the advance of said die from the start point of the depression spreading portion of said die or its proximity up to the start point of the finishing portion or its proximity.

1 Claim, 15 Drawing Figures

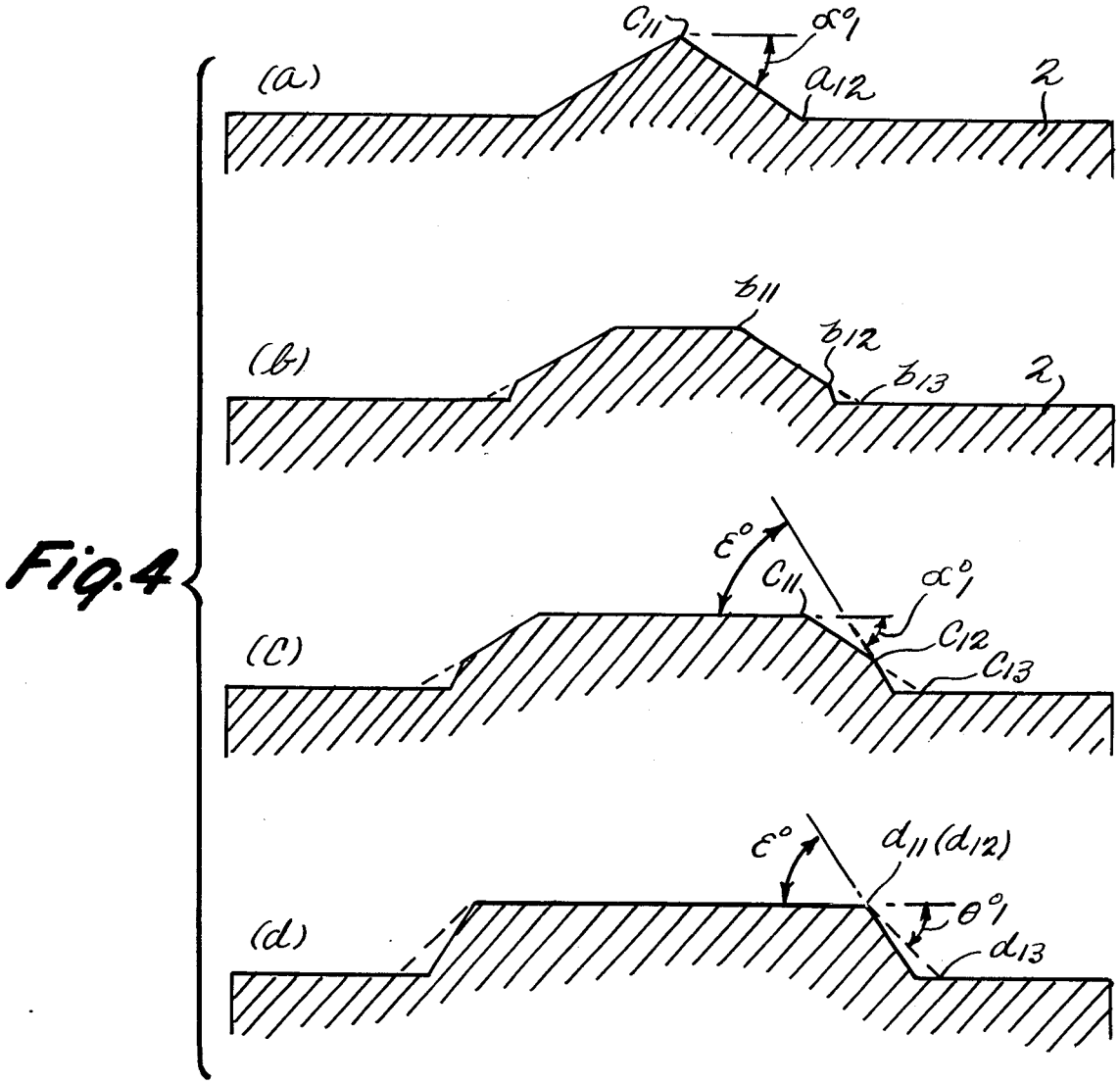
Fig. 4
Fig. 5
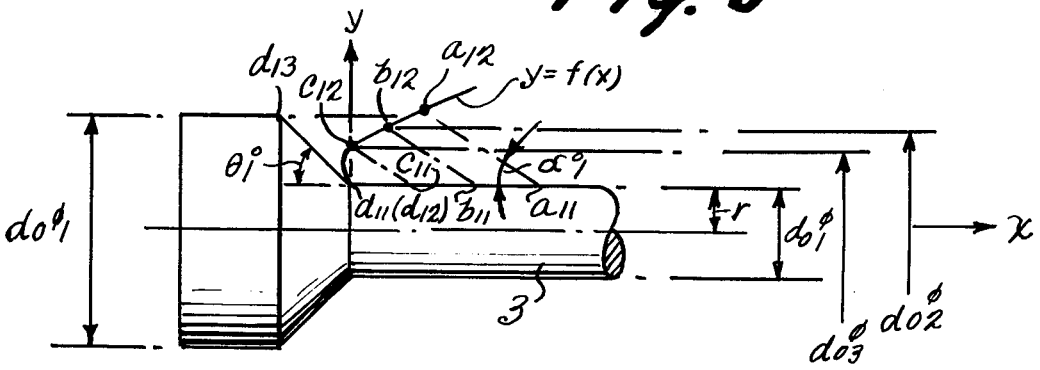

ROLL-FORMING DIES IN A CROSS-ROLLING MACHINE

FIELD OF THE INVENTION

The present invention relates to improvements in rollforming dies in a cross-rolling machine for shaping a stepped shaft from a cylindrical raw material rod.

BACKGROUND OF THE INVENTION

An outline of shaping work of a stepped shaft by means of a cross-rolling machine is shown in FIGS. 1 and 2. FIG. 1(*a*) shows a cross-rolling process by means of rolling dies, while FIG. 1(*b*) shows an operating state where flat dies are employed. In FIG. 1(*a*), a raw material rod 03 is interposed between rolls 01, 01, so that as the rolls 01, 01 rotate in the same direction the raw material rod can be pinched to be shaped into a desired form by means of dies 02, 02 mounted on the rolls 01, 01, respectively.

In FIG. 1(*b*) also, the operation principle is the same as that explained with reference to FIG. 1(*a*), and the only difference exists in that the dies are developed on flat planes.

FIGS. 2(*a*), 2(*b*) and 2(*c*) illustrate the steps of shaping a raw material rod upon roll-forming a raw material rod having a diameter $d_o$ until the diameter of its center portion is reduced to $d$ as the aforementioned dies rotate or advance.

At II-a in FIG. 2(*a*) is shown a developed plan view of a roll-forming die, and at II-b on the left side of the same figure is shown a cross-section view of the final part of the same die taken at right angles to the direction of advance. In addition, at II-c in FIG. 2(*b*) is shown a longitudinal cross-section view of the same die, and FIG. 2(*c*) shows at III-a to III-e the roll-formed states of the raw material rod at various portions of the die. For instance, at III-c is shown the state of the raw material rod when it is positioned along line Z—Z on the die while being roll-formed. In these figures, reference characters $\alpha$ and $\beta$ designate a wedge angle and an advance angle, respectively, of the die, and reference character $h$ designates a height of the die, as known in the art.

A cylindrical raw material rod is successively shaped and finished into a final product while the dies are advanced and roll-forming proceeds as shown at III-a to III-e in FIG. 2(*c*).

In addition, as well-known in the art, a die basically consists of a bite portion A, a depression spreading portion B and a finishing portion C as shown at II-a in FIG. 2(*a*), and these portions, respectively, achieve the rolls of biting into a rawmaterial rod up to a predetermined diameter $d$ of a product, further spreading a depression of the raw material rod along a predetermined cylindrical surface or a predetermined contour, and smoothly finishing the product so as to have a desired final product shape. In FIG. 2, at III-b is shown the shape of the roll-formed article at the end point of the bite portion, that is, at the start point of the depression spreading portion, at III-d is shown the shape of the roll-formed article at the end point of the depression portion, that is, at the start point of the finishing parallel portion, and at III-e is shown the shape of the final product. The cross-section shapes of the die at the cross-sections corresponding to the roll-formed articles shown at III-d and III-e, respectively, are the same, and the heights $h$ of the die at the cross-sections corresponding to the roll-formed articles shown at III-b, III-c, III-d and III-e, respectively, are kept constant.

However, as well-known in the art, if the ratio $d/d_o$ of the final diameter $d$ of the product to the diameter $d_o$ of the raw material rod or the maximum diameter $d_o$ of the product as shown in FIG. 2(*c*) is too small, that is, if a diameter reduction factor $d_o/d$ is too large, then during the roll-forming work, a piercing phenomenon due to Mannesmann effects would arise at the center of the shaft portion, constriction (notching) would occur at the shaft portion of the product, or in the worst case the product would be torn off. Therefore, roll-forming of a stepped shaft having a large diameter reduction faction was impossible by means of the conventional dies.

As described above, the diameter reduction factor that can be imposed to an article by means of the conventional dies for use in a cross-rolling machine was limited, and the limit value of the diameter reduction factor would vary depending upon the wedge angle $\alpha$ and the advance angle $\beta$ as shown in FIG. 2, but normally it was substantially equal to 75%. Accordingly, shaping of a stepped shaft by employing the cross-rolling process was limited with respect to the diameter reduction factor, and there were many unpracticable cases, in which a great cost reduction could be expected if the cross-rolling process were to be applicable.

In FIGS. 3(*a*) and 3(*b*) is shown the relation between a rod being roll-formed and dies at any arbitrary position within the depression spreading portion B as shown in FIG. 2(*a*), and in these figure, reference numerals 02*a* and 03*a* designate cross-sections of the dies and the rod being roll-formed, respectively, taken along the axis of the rod. The cause of the generation of constriction (notching) in the case of the conventional dies for cross-rolling machines, was a component of force $P_Y$ in the axial direction of the rod being roll-formed of a roll-forming force P exerted upon the rod 03 being roll-formed via the pinching surfaces 04 during the roll-forming process as shown in FIG. 3(*a*), and the rod 03 being roll-formed has its cylindrical portion having a diameter $d$ and placed between the unpinching top surfaces 05, 05 of the dies subjected to an axial tension $2P_Y$ via the pinching surfaces 04, 04 of the dies on both the upper and lower sides, as shown in the figure. In this case, assuming that the diameter $d_o$ of the raw material rod or the maximum diameter $d_o$ of the product is kept constant and the wedge angle $\alpha$ as well as the advance angle $\beta$ shown in FIG. 2 are also kept constant, then the length of the pinching surface 04 as measured along the direction inclined by the wedge angle $\alpha$ with respect to the axis is increased as the minimum diameter $d$ of the product is reduced, and thus the roll-forming force is increased, so that the axial tension $2P_Y$ is also enhanced. In addition, as the minimum diameter $d$ is reduced, the circular cross-section area $\pi/4d^2$ of this portion taken ar right angles to the axis is also reduced, so that the tensile stress $2P_Y/\pi/4d^2$ is further increased, and if this tensile stress value exceeds a predetermined value, then constriction would arise in the material similarly to the case of tension test.

SUMMARY OF THE INVENTION

As described above, the cause of generation of constriction during the roll-forming process is the tensile stress generated in the shaft portion having the maximum diameter by the component of force $P_Y$ in the axial direction of the raw material rod of the roll-forming force P, so that the following two solutions are thought of for preventing the generation of constriction.

1. Reducing the tensile force $2P_Y$ in the axial direction of the raw material rod.
2. Enlarging the cross-section of the minimum diameter portion of the raw material rod being roll-formed.

We have invented novel roll-forming dies which are free from the aforementioned limitation for the diameter reduction factor and capable of roll-forming even a product having a diameter reduction factor of 100%, and which can self-generate a shaped surface at any arbitrary angle.

It is an object of the present invention to provide novel dies for roll-forming which can perfectly prevent constriction (notching) phenomena from arising in the article being roll-formed during the aforementioned roll-forming process, by combining two novel improvements in the roll-forming dies to obtain a cooperative effect of the merits of the respective improvements.

According to one feature of the present invenion, there are provided roll-forming dies in a cross-rolling machine which can stretch by forging a shaft portion of a stepped cylindrical article having a large diameter reduction factor as a roll-forming operation by top portions of said dies proceeds, characterized in that each said die comprises a die top portion contacting with a raw material rod during roll-forming and finishing operations thereof, whose height with respect to a reference surface of said die is successively and continuously increased in the direction of advance of the die from a start point of a depression spreading portion of the die or its proximity up to a start point of a finishing portion or its proximity, and also in that a width of a shaping inclined surface of the roll-forming die is gradually reduced in the direction of the advance of said die from the start point of the depression spreading portion of said die or its proximity up to the start point of the depression spreading portion of said die or its proximity up to the start point of the finishing portion or its proximity, whereby a shaped surface any arbitrary inclination angle can be self-generated.

BRIEF DESCRIPTION OF THE DRAWINGS

Above-mentioned and other features and objects of this invention will become more apparent by reference to the following description taken in conjunction with the accompanying drawings,in which:

FIG. 5 is a schematic partial view of an article being roll-formed for explaining the successive steps of the depression spreading process at the die positions illustrated in FIGS. 4(*a*), 4(*b*), 4(*c*) and 4(*d*), respectively.

DETAILED DESCRIPTION OF THE PRESENTLY PREFERRED EMBODIMENT

Figure 8:
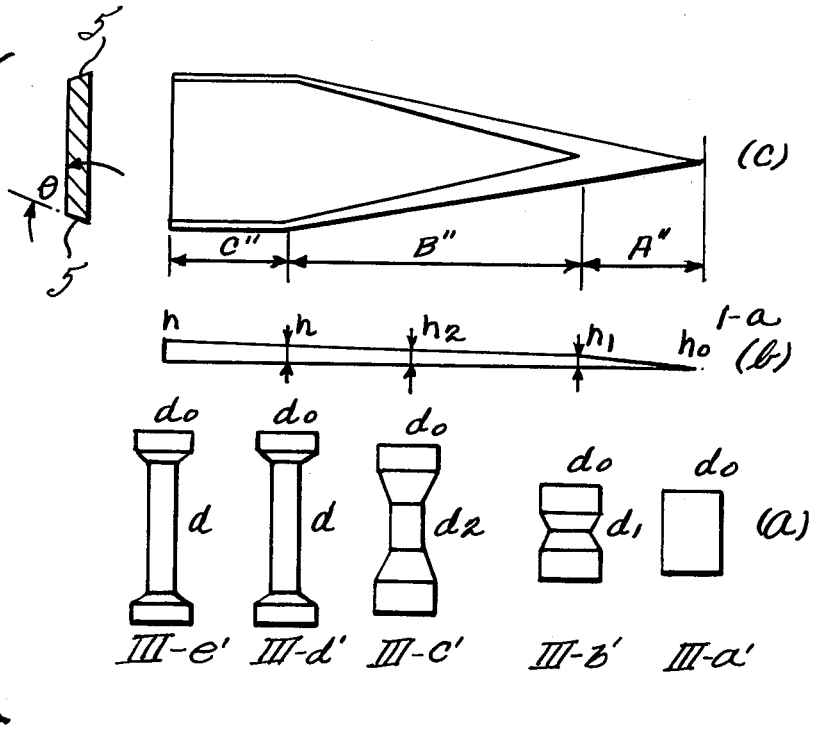
FIG. 8 shows a configuration of a novel improved roll-forming die according to the present invention together with the shapes of the roll-formed articles at the successive steps of the roll-forming process by means of the same die.

Before entering an explanation of the novel improved roll-forming die according to the present invention as shown in FIG. 8, we will explain the first and second features of the invention individually so as to facilitate understanding the essence of our subject invention.

Referring now to FIGS. 4 and 5 of the drawings, forming dies 2, 2 constructed according to a first feature of the invention have a wedge angle $\alpha_1$, and the width of the shaping inclined surfaces of said forming dies is gradually and continuously varied or reduced as shown at $\overline{a_{11}a_{12}}$, $\overline{b_{11}b_{12}}$, $\overline{c_{11}c_{12}}$ and $d_{11}$ ($d_{12}$) in FIGS. 4(*a*), 4(*b*), 4(*c*) and 4(*d*), and is finally converged to a point $d_{11}$ ($d_{12}$). In order to provide the above-described reduction in width of the shaping inclined surfaces, clearance surfaces are formed in the shaping inclined surfaces at an appropriate escape angle $\epsilon$ as shown in these figures, so that the roll-forming operation of the raw material rod 3 is not effected by the clearance surfaces other than the above-referred shaping inclined surfaces $\overline{a_{11}a_{12}}$, $\overline{b_{11}b_{12}}$, $\overline{c_{11}c_{12}}$ and $d_{11}$ ($d_{12}$).

When the dies 2, 2 constructed as described above are attached to a pair of rolls in a cross-rolling machine to effect shaping work of a raw material rod, the dies 2, 2 bite into the raw material rod and form said raw material rod while spreading a depression axially outwardly with the wedge angle $\alpha_1$. During this process, the width of the shaping inclined surfaces of said forming dies is gradually and continuously varied or reduced as shown at $\overline{a_{11}a_{12}}$, $\overline{b_{11}b_{12}}$, $\overline{c_{11}c_{12}}$ and $d_{11}$ ($d_{12}$), and finally the width converges into a point $d_{11}$. In addition, the dies 2,2 have clearance surfaces formed in the shaping inclined surfaces at an appropriate escape angle $\epsilon$, and the roll-forming operation is not effected by the clearance surfaces other than the shaping inclined surfaces, so that the surfaces of the raw material rod being roll-formed, which have left the shaping inclined surfaces of the dies 2, 2, can be shaped into a fixed form of self-generating surface that is determined only by the variation in width of the shaping inclined surfaces of the dies. FIGS. 4(*b*), 4(*c*) and 4(*d*) show the case where a self-generating surface having a linear cross-section such as $\overline{b_{12}b_{13}}$, $\overline{c_{12}c_{13}}$ and $\overline{d_{11}d_{13}}$ can be obtained during the aforementioned shaping process, and in this case the inclination angle $\theta_1$ of the finally established self-generating surface $\overline{d_{11}d_{13}}$ would define the shaping angle $\theta_1$ of the product (the inclination angle of the conical surface between the outer diameter portion and the neck portion of the product) as shown in FIG. 5.

It is to be noted that the variation in width of the shaping inclined surface of the dies for obtaining any desired self-generating surface, i.e., the curve of $y = f(x)$ (See FIG. 5), can be determined by repeating the try-and-error processes in the field in accordance with the desired shape of the self-generating surface, but in the case of certain shapes of self-generating surfaces, mostly it can be theoretically obtained by volumetric calculation of the raw material rod.

The above-described process is always possible so long as $\alpha_1 \geqq \theta_1$.

In case of effecting roll-forming work by means of the above-described dies, since the width of the shaping inclined surface of the dies having a die wedge angle $\alpha_1$ is varied or reduced gradually, and also since the practical diameter ratio is gradually increased as $d_1/d_{01}$, $d_1/d_{02}$, $d_1/d_{03}$ while the roll-forming work proceeds although the virtual diameter ratio $d_1/d_{01}$ of the raw material rod being roll-formed is kept constant (See FIG. 5), the axial tensile force exerted upon the raw material rod via the shaping inclined surfaces of the dies is prevented from increasing excessively, so that constriction or break off of the shaft cannot occur.

Since the dies according to the first feature of the present invention have the above-described construction and function, according to the first feature of the invention it has become possible to establish a self-generating surface at any arbitrary inclination angle $\theta_1$ while maintaining the wedge angle $\alpha_1$ constant, so long as the inclination angle $\theta_1$ at any portion of the self-generating surface is larger than the wedge angle (the inclination angle of the shaping inclined surface) $\alpha_1$ as described above. In addition, since the width of the shaping inclined surface of the dies is varied and reduced gradually during the roll-forming work, the practical diameter ratio is also increased gradually as $d_1/d_{01}$, $d_1/d_{02}$, $d_1/d_{02}$, $d_1/d_{03}$, so that the axial tensile force exerted upon the raw material rod via the shaping inclined surfaces of the dies is prevented from increasing excessively. Therefore, the present invention can achieve practical effects for widely expanding the scope of utilization of the cross-rolling process for shaping, in that the risk of constricting or braking off the shaft is eliminated, and in that roll-forming of even an article having a very small diameter ratio $d_1/d_0$ becomes possible.

Figure 1:
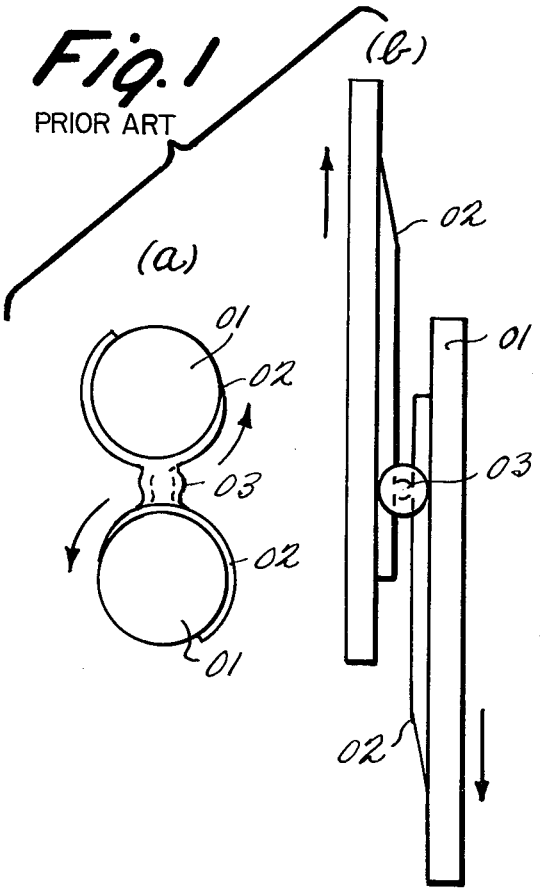
Fig. 1 PRIOR ART
FIGS. 1(*a*) and 1(*b*) are schematic views showing an outline of a roll-forming process by means of the conventional roll-forming dies of rotary type and flat type, respectively, in the cross-rolling machines in the prior art, FIGS. 2(*a*), 2(*b*) and 2(*c*) show more detailed configurations of the conventional roll-forming dies in FIG. 1(*a*) or 1(*b*) and shapes of an article being roll-formed at a number of successive steps in the roll-forming process, FIGS. 3(*a*) and 3(*b*) are an enlarged partial cross-section view and a partial side view, respectively, of the conventional roll-forming dies illustrated in FIG. 1(*b*), FIGS. 4(*a*), 4(*b*), 4(*c*) and 4(*d*) are schematic views showing cross-sections of a roll-forming die according to a first feature of the present invention taken at various transverse cross-sections within the depression spreading portion of said die.
Figure 2:
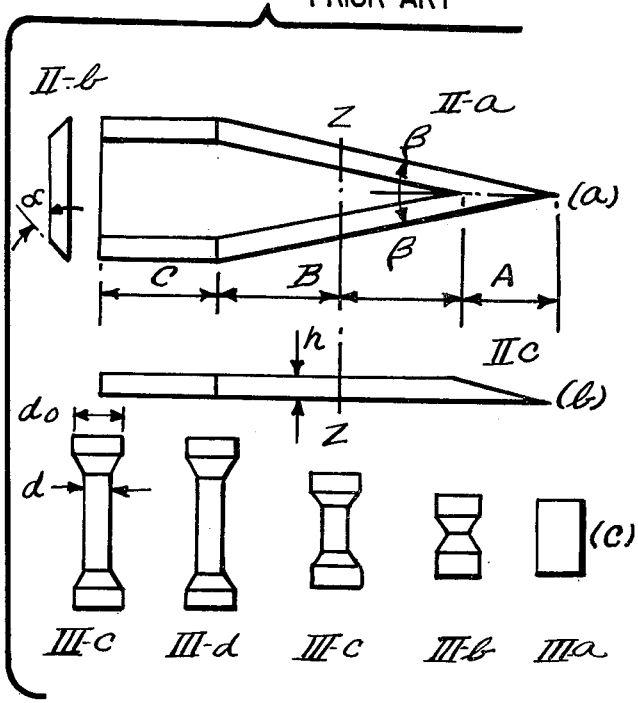
Fig. 2 PRIOR ART
Figure 3:
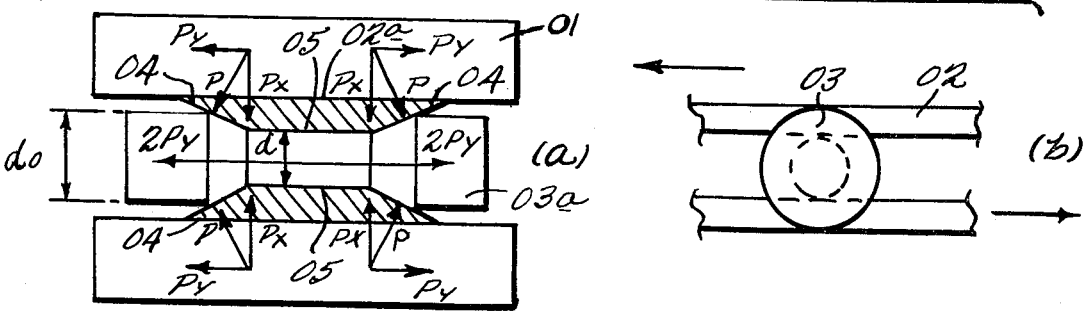
Fig. 3 PRIOR ART
Figure 6:
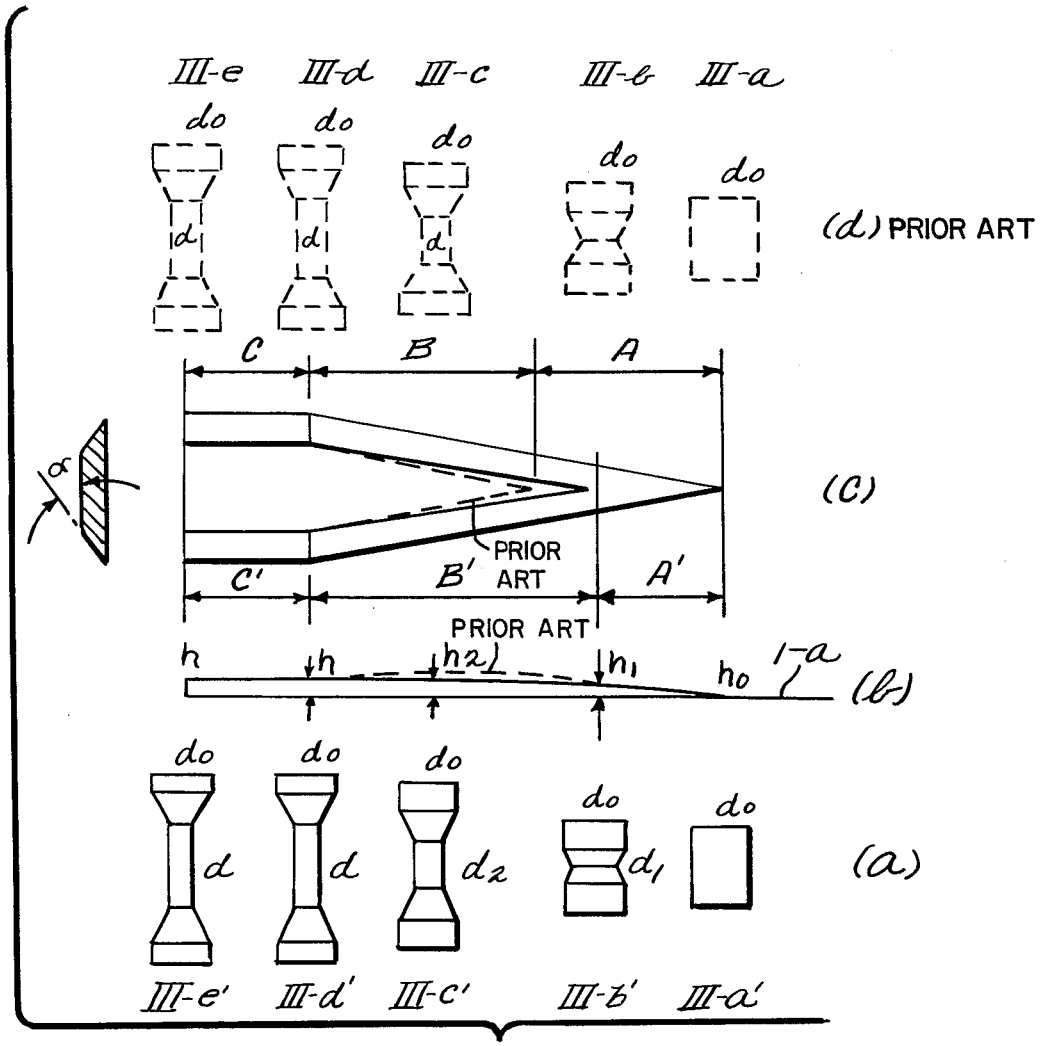
FIG. 6 shows a configuration of an improved roll-forming die according to a second feature of the present invention together with the shapes of the roll-formed articles at the successive steps of the roll-forming process by means of the same die, in contrast to the case of the conventional roll-forming die as represented by dash-lines.

Referring now to FIGS. 6(*a*), 6(*b*), 6(*c*) and 6(*d*) of the drawings, one example of the novel roll-forming die in which the second feature of the present invention is incorporated in the basic roll-forming die illustrated in FIG. 2. In FIG. 6(*a*), the articles being roll-formed by means of the roll-forming dies incorporating the second feature of the present invention at various shaping steps are shown at III-a' to III-e', and in this figure, reference character $d_0$ designates a diameter of the raw material rod, while reference characters $d_1$, $d_2$ and $d$ represent the variation of diameter of the roll-formed articles at various steps of the roll-forming process as measured at the minimum diameter portion of the product. FIG. 6(*b*) is a longitudinal cross-section view of the same die, in which a cross-section of the conventional die is represented by dash-lines. Similarly, FIG. 6(*c*) is a plan view of the same die, in which a shape of the conventional die is represented by dash-lines. Similarly to the illustration in FIG. 2, reference characters A, b and C, respectively, designate a bite portion, a depression spreading portion and a finishing parallel portion of the conventional die, whereas reference characters A', B' and C' designate a bite portion, a depression spreading portion and a finishing parallel portion of the die incorporating the second feature of the present invention. In addition, the figure shown at the bottom of FIG. 6(*c*) represents the cross-section configuration of the final part of the same die.

FIG. 6(*d*) shows at III-a to III-e the articles being roll-formed by means of the conventional dies at various steps of the roll-forming process, similarly to FIG. 2(*c*). In this figure, reference character $d_0$ represents the diameter of the raw materialrod, while reference character $d$ represents the diameters of the various steps of the roll-forming process as measured at the minimum diameter portion of the product, which are constant in this case. More particularly, the pinching surfaces 4 and the top surfaces 5 of the dies are continuously expanded in the axial direction along the contour of the product, except for the bite portion A.

As described above, in contrast to the fact that the die height with respect to the die reference surface 1-a in FIG. 6(*b*) of the depression spreading portion B of the conventional die has a fixed value $h$ and the top surface 5 between the pinching surfaces 4 as shown in FIG. 6(*c*) is always located on the final contour line of the roll-formed article, the height of the depression spreading portion B' of the die according to the present invention does not take a fixed value along the direction of advance of the die, but it takes a value $h_1$ at the start point of the depression spreading portion, and an intermediate height $h_2$ between the initial height $h_1$ and the final height $h$ (the height at the start point of the finishing portion) at the intermediate position of the depression spreading portion, the relation of $h_1 \leqq h_2 \leqq h$ being satisfied, and in the depression spreading portion the die height is successively and smoothly raised from $h_1$ through $h_2$ to $h$.

Figure 7:
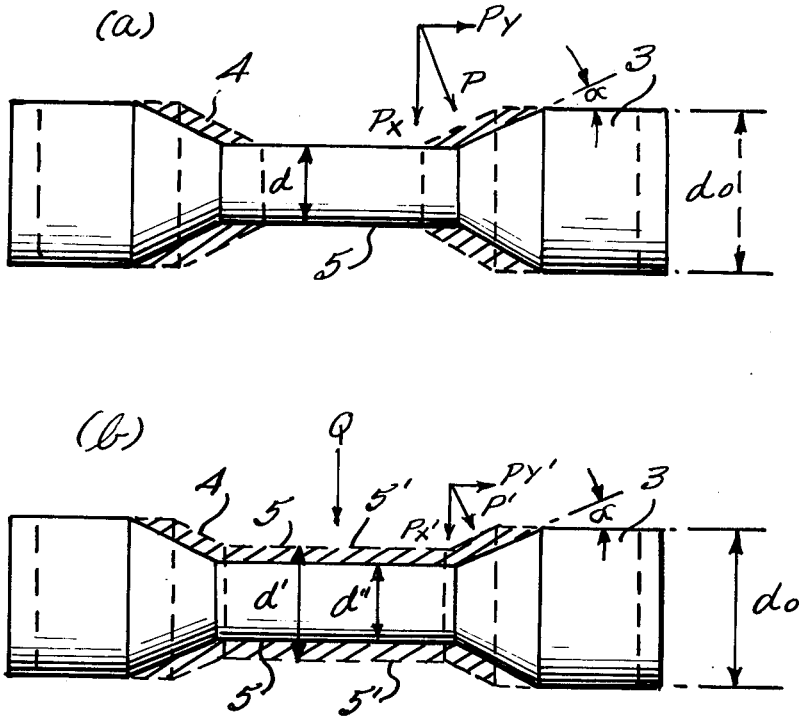
FIG. 7 shows the difference in the operation principles of the roll-forming processes between the conventional roll-forming dies and the improved roll-forming dies as illustrated in FIG. 6.

In FIG. 7 is illustrated the operation principle of the roll-forming die incorporating the second feature of the present invention in comparison to the operation principle of the conventional roll-forming dies. FIG. 7(*a*) is a schematic view showing the steps of deformation of the article being roll-formed by the depression spreading portions of the conventional dies as viewed from a direction perpendicular to the axis of said article, while FIG. 7(*b*) is a schematic view showing the steps of deformation by means of the dies incorporating the second feature of the present invention as viewed in the same direction. In these figures, reference numeral 3 designates an article being roll-formed, numeral 4 designates pinching surfaces for shaping, and numeral 5 designates a die top surface. Dash-lines show the shape of the article being roll-formed at a step prior to the step of roll-forming shown by solid lines. Accordingly, the roll-forming dies shape by pinching the article being roll-formed by an amount corresponding to the area of the hatched sections. In the case of the conventional dies, the article being roll-formed is pinched and stretched by forging with only the pinching surfaces for shaping 4 as shown in FIG. 7(*a*), so that the tensile stress within the cylindrical portion having a diameter $d$ of the article being roll-formed, which is generated by a component of force $P_Y$ in the axial direction of said article of the roll-forming force P exerted via the pinching surfaces shown in the figure, is proportional to $P_Y/\pi/4d^2$.

Whereas, in the case of the dies incorporating the second feature of the present invention, since the height of the die top portion is successively raised as shown in FIG. 6(*b*), the portion of the article being roll-formed represented by dash-lines in FIG. 7(*b*) as having a diameter *d* is stretched by forging in the axial direction with the die top portions 5, 5 until the diameter is reduced to *d*" as defined by solid lines 5, 5 in the figure. Accordingly, the substantial pinching amount shaped by the pinching surfaces 4 of the dies is reduced, because the inclined surface portions of the article being roll-formed escape to the opposite sides by an amount corresponding to the volume of the tubular portion between the dash-lines 5', 5'. Therefore, the roll-forming force P' necessarily becomes smaller than the roll-forming force P in the case of the aforementioned conventional dies, so that the axial component $P'_Y$ of the toll-forming force P is also reduced smaller than the axial component $P_Y$ in the case of the conventional dies.

Furthermore, since the diameter *d*" of the shaft through which a tensile stress is exerted in the illustrated case is larger than the ahsft diameter *d* of the final prodportional to $P'_Y/\pi/4d''^2$, is far smaller than the axial tensile stress $P_Y/\pi/4d^2$ in the article being roll-formed by means of the conventional dies as described above.

As described above, the second feature of the present invention is characterized in that an article having a large diameter reduction factor which could not be roll-formed by means of the conventional dies, can be roll-formed without generating constriction by positively stretching through forging the portion of the article corresponding to the minimum diameter and thus reducing the axial tensile stress within the minimum diameter portion.

Now the roll-forming dies according to the present invention will be described in more detail with reference to FIGS. 8(*a*), 8(*b*) and 8(*c*).

FIG. 8(*b*) is a developed view showing a longitudinal cross-section shape of a roll-forming die according to the present invention, and FIG. 8 (*c*) is a developed plan view of the same. In these figures, reference numeral 2' designates a roll-forming die, numeral 1-*a* designates a reference surface of the die, character A" designates a bite portion, character B" designates a depression spreading portion, character C" designates a finishing portion, and the height of the die 2' according to the present invention with respect to the reference surface 1-*a* is successively and continuously raised as the roll-forming process by said die 2' proceeds so that it takes a value $h_1$ at the start point of the depression spreading portion B" or its proximity, a value $h_2$ at the intermediate point of the depression spreading portion B", and a value *h* at the start point of the finishing portion C" or its proximity. Such a construction is exactly similar to the improved die which was described previously with reference to FIGS. 6 and 7, and therefore it can achieve the same function and effect as said improved die. In addition, the width of the shaping inclined surfaces of the roll-forming die 2' according to the present invention is gradually reduced from the start point of the depression spreading portion B" of the die 2' or its proximity up to the start point of the finishing portion C" or its proximity as the roll-forming process by said die 2' proceeds, and the construction of the die 2' with respect to this feature is exactly similar to the improved die which was described previously with reference to FIGS. 4 and 5. Therefore, the roll-forming die according to the present invention can achieve the same function and effect as said improved die shown in FIGS. 4 and 5.

In other words, the roll-forming die according to the present invention incorporates the constructions characteristic of the above-described two improved dies, so that it can simultaneously achieve the functions and effects of the respective improved constructions. It will be readily appreciated that the axial tension stress within the article being roll-formed (the raw material rod) during the roll-forming process becomes further smaller than that of either one of the above-described improved dies owing to the cooperative effect of the two improvements. FIG. 8(*a* ) shows the successive states in the process of roll-forming an article having a diameter $d_0$ with the dies according to the present invention, in which the diameter of the minimum diameter portion is varied from $d_1$ through $d_2$ to *d*.

Experimental results obtained by employing the roll-forming dies according to the present invention prove that the roll-forming force exerted upon the article being roll-formed during the roll-forming process is not only smaller than that in the case of the conventional roll-forming dies, but also it is smaller than that in the case of the improved roll-forming dies incorporating either the first or second feature of the invention, and accordingly, the axial component of the tensile force was also reduced and the defects of the article being roll-formed such as constriction at the minimum diameter shaft portion did not arise at all. This is believed to be a result of the cooperative effect of the functions and advantages of the above-referred first and second improvements.

In summary, since the roll-forming dies according to the present invention have the above-described constructions and functions, the present invention can achieve a practical effect that the scope of the applicable field for the roll-forming process of stepped cylindrical parts with a cross-rolling machine can be greatly broadened.

Since many changes could be made in the above construction and many apparently widely different embodiments of this invention could be made without departing the scope thereof, it is intended that all matter contained in the above description or shown in the accompanying drawings shall be interpreted as illustrative and not in a limiting sense.

What is claimed is:

1. Roll-forming dies in a cross-rolling machine, which can stretch by forging a shaft portion of a stepped cylindrical article having a large diameter reduction factor as a roll-forming operation by top portions of said dies proceeds, characterized in that:

each said die comprises: a die top portion contacting with a raw material rod during roll-forming and finishing operations thereof, whose height with respect to a reference surface of said die is successivelyand continuously increased in the direction of advance of the die from a start point of a depression-spreading portion of the die up to a start point of a finishing portion thereof; and also in that the width of a shaping inclined surface of the roll-forming die is gradually reduced in the direction of the advance of said die from the start point of the depression-spreading portion of said die up to the start point of the finishing portion, whereby a shaped surface having any arbitrary inclination angle can be self-generated.

* * * * *